US008417171B2

(12) United States Patent
Christopher et al.

(10) Patent No.: US 8,417,171 B2
(45) Date of Patent: Apr. 9, 2013

(54) METHOD AND APPARATUS FOR PRINTING EMBOSSED REFLECTIVE IMAGES

(75) Inventors: Leonard R. Christopher, Palmyra, NY (US); Thomas N. Tombs, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 290 days.

(21) Appl. No.: 12/257,452

(22) Filed: Oct. 24, 2008

(65) Prior Publication Data

US 2010/0104336 A1 Apr. 29, 2010

(51) Int. Cl.
*G03G 15/20* (2006.01)

(52) U.S. Cl. ..... 399/341; 399/342

(58) Field of Classification Search ..... 399/341
See application file for complete search history.

(56) References Cited

U.S. PATENT DOCUMENTS

| | | | | |
|---|---|---|---|---|
| 2,955,035 | A | 10/1960 | Walkup et al. | |
| 4,833,018 | A | 5/1989 | Ruehl et al. | |
| 4,871,408 | A * | 10/1989 | Honma et al. | 156/83 |
| 4,965,131 | A | 10/1990 | Nair et al. | |
| 5,520,763 | A * | 5/1996 | Johnstone | 156/233 |
| 5,824,447 | A * | 10/1998 | Tavernier et al. | 430/124.13 |
| 5,948,585 | A | 9/1999 | Gady et al. | |
| 7,139,521 | B2 | 11/2006 | Ng et al. | |
| 7,468,820 | B2 | 12/2008 | Ng et al. | |
| 7,593,656 | B2 * | 9/2009 | Boness et al. | 399/49 |
| 2006/0188295 | A1 * | 8/2006 | Kasiske et al. | 399/182 |
| 2008/0159786 | A1 * | 7/2008 | Tombs et al. | 399/222 |

FOREIGN PATENT DOCUMENTS

| | | | |
|---|---|---|---|
| DE | 195 40 584 | A1 | 4/1997 |
| JP | 62279988 | A * | 12/1987 |
| JP | 2004074422 | A * | 3/2004 |

OTHER PUBLICATIONS

English Abstract of JP62-279988.*

* cited by examiner

*Primary Examiner* — Walter L Lindsay, Jr.
*Assistant Examiner* — David Bolduc

(57) ABSTRACT

A printing method for producing a textured thin film image (142) upon a receiver (20(R)) is provided. The method may include the steps of a. depositing one or more toner images (50) to form a predetermined adhesive image (50) with more than one level of height; and b. applying and fixing a foil (30) to at least a portion of the adhesive image to create a textured thin film image (142).

24 Claims, 11 Drawing Sheets

METHOD AND APPARATUS FOR PRINTING EMBOSSED REFLECTIVE IMAGES

FIELD OF THE INVENTION

This invention relates in general to electrographic printing, and more particularly to printing embossed textured reflective images.

BACKGROUND OF THE INVENTION

One method for printing images on a receiver member is referred to as electrography. In this method, an electrostatic image is formed on a dielectric member by uniformly charging the dielectric member and then discharging selected areas of the uniform charge to yield an image-wise electrostatic charge pattern. Such discharge is typically accomplished by exposing the uniformly charged dielectric member to actinic radiation provided by selectively activating particular light sources in an LED array or a laser device directed at the dielectric member. After the image-wise charge pattern is formed, the pigmented (or in some instances, non-pigmented) marking particles are given a charge, substantially opposite the charge pattern on the dielectric member and brought into the vicinity of the dielectric member so as to be attracted to the image-wise charge pattern to develop such pattern into a visible image.

Thereafter, a suitable receiver member (e.g., a cut sheet of plain bond paper) is brought into juxtaposition with the marking particle developed image-wise charge pattern on the dielectric member. A suitable electric field is applied to transfer the marking particles to the receiver member in the image-wise pattern to form the desired print image on the receiver member. The receiver member is then removed from its operative association with the dielectric member and the marking particle print image is permanently fixed to the receiver member typically using heat, and/or pressure and heat. Multiple layers or marking materials can be overlaid on one receiver, for example, layers of different color particles can be overlaid on one receiver member to form a multi-color print image on the receiver member after fixing.

With the improved print image quality, print providers and customers alike have been looking at ways to expand the use of electrographically produced prints. In certain classes of printing, a tactile feel to the print is considered to be highly desirable. Specifically, ultra-high quality printing such as for stationary headers or for business cards utilize raised letter printing to give a tactile feel to the resultant print output. Some other instances where tactile feel in the print would be desirable are Braille prints or print documents, which have security features provided there within.

Moreover, print providers have also been looking for ways to efficiently deposit patterned conductive or reflective thin film structures on top of raised printing. Moreover, print providers have been looking for cost effective ways to deposit additional toner on top of reflective thin film structures that have been deposited on top of raised printing.

SUMMARY OF THE INVENTION

In one exemplary embodiment, a printing method for producing a textured thin film image upon a receiver is provided. The method may include the steps of a. depositing one or more toner images to form a predetermined adhesive image with more than one level of height; and b. applying and fixing a foil to at least a portion of the adhesive image to create a textured thin film image.

In another exemplary embodiment, an apparatus for producing a textured thin film image upon a receiver is provided. The apparatus may include a first imaging device that facilitates depositing at least one toner image on a receiver to form a predetermined adhesive first toner image that has a first height; a second imaging device that facilitates depositing at least one toner image on the receiver to form a predetermined adhesive second toner image that has a second height, the first height of the first toner image is substantially greater than the second height of the second toner image; and an application device that facilitates coupling a thin film layer to at least one of the first toner image and the second toner image.

The invention, and its objects and advantages, will become more apparent in the detailed description of the exemplary embodiments described herein.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Referring now to the accompanying drawings, FIGS. 1-5 are side elevation views schematically showing portions of an electrographic print engine or printer apparatus suitable for printing embossed reflective images. In one embodiment, the invention may involve printing using an electrophotographic engine that may have five image printing stations or modules arranged in tandem and an optional finishing assembly. The invention contemplates that more or less than five stations may be combined to deposit toner and apply one or more layers of a thin metal film on a single receiver member to produce digitally patterned embossed reflective images, or may include other typical electrographic writers, printer apparatus, or other finishing devices. In another embodiment, printer apparatus may include a single printing station or module that may facilitate supplying a toner that acts as an adhesive when fused.

An electrographic printer apparatus 100 as shown in FIGS. 1-4 may have a receiver member supply source (not shown), a finishing assembly 102 and one or more printing modules, or electrostatographic image forming printing modules M1, M2, M3, M4 and M5 extending therebetween. Printing modules M1-M5 may be arranged in tandem along an endless transport web 104. Each of printing modules M1-M5 may generate a single-color toner image for transfer to a receiver member 20(R) successively moved through printing modules M1-M5. Additional modules may be provided.

Figure 1:
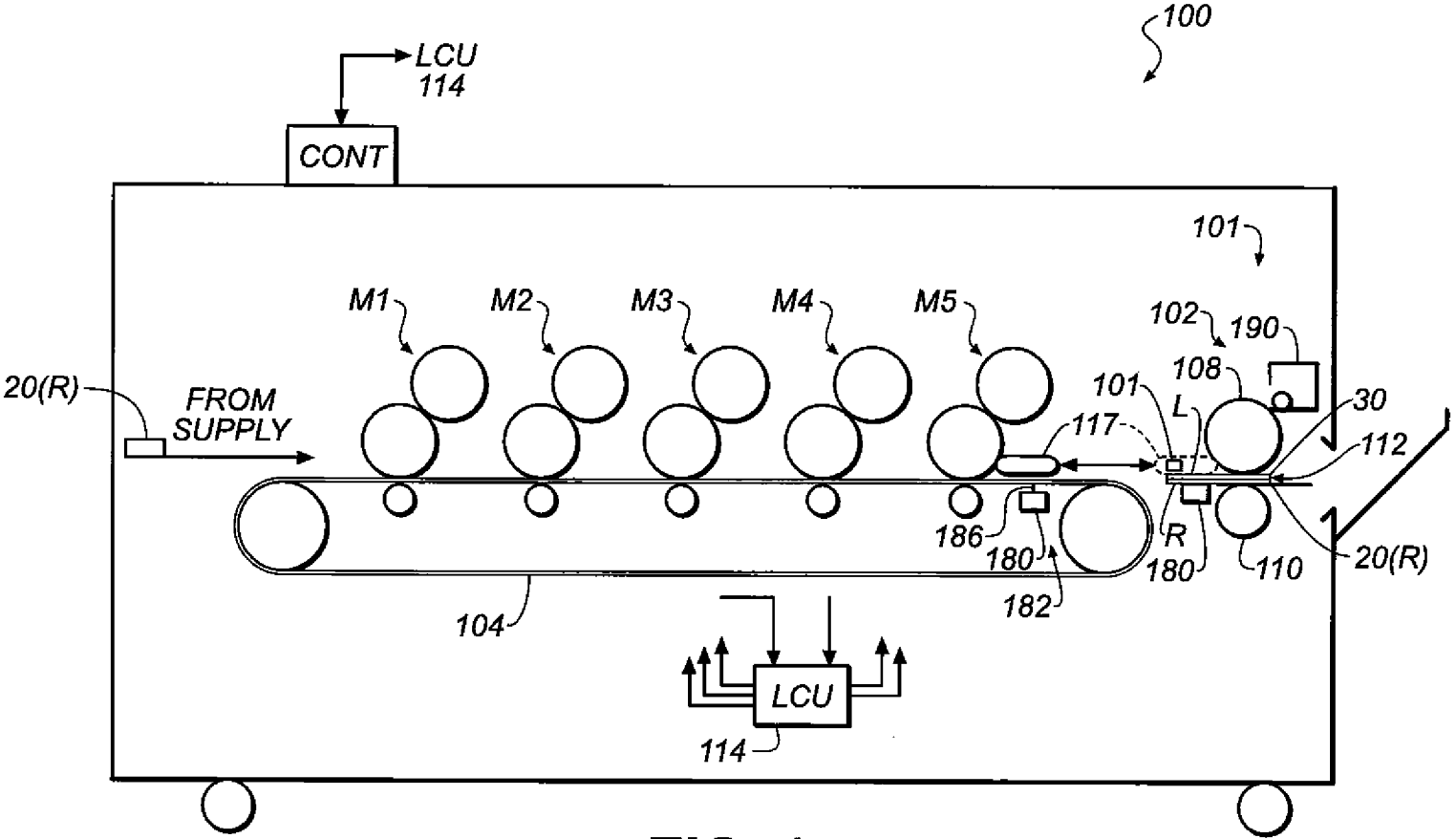
FIG. 1 is a schematic cross-sectional side view of an electrographic reproduction apparatus suitable for use with this invention.

In one embodiment as shown in FIG. 1, finishing assembly 102 may include a thin film applicator 106, wherein a thin film 30 may be activated by the digitally patterned image in a fuser while the thin film 30 is applied. Finishing assembly 102 may also have a fuser roller 108 and an opposing pressure roller 110 that may form a fusing nip 112 therebetween.

In a course of operation of the above-described embodiment, during a single pass through of printing modules M1-M5, up to five single-color toner images may be transferred to receiver member 20(R) to form a pentachrome image. As used herein, the term "pentachrome" implies that in an image formed on receiver member 20(R) includes combinations of the subsets of the five colors to form a plurality of other colors on receiver member 20(R) at various locations thereon.

In one embodiment, printing module M1 may form black (K) toner color separation images, printing module M2 may form yellow (Y) toner color separation images, printing module M3 may form magenta (M) toner color separation images, and printing module M4 may form cyan (C) toner color separation images. Printing module M5 may form any other fifth color separation image or may be a clear toner. In the exemplary embodiment, the clear toner may act as a thin film adhesive (A) when activated by heat, pressure or other known method. Moreover, thin film adhesive may enable the toner to be used as the film image pattern, as described in more detail below. Accordingly, patterned areas may be laid down on receiver member 20(R) in a pattern of toner 40, contacted by the thin film layer 30 and activated by heat, pressure and/or other activation methods to produce a digitally patterned thin film print 50. Such film prints 50 may be useful for decorative images, such as, nut not limited to, logos, for image protective purposes, for scratch offs and embossing and/or for conductive or electrical purposes.

Figure 3:
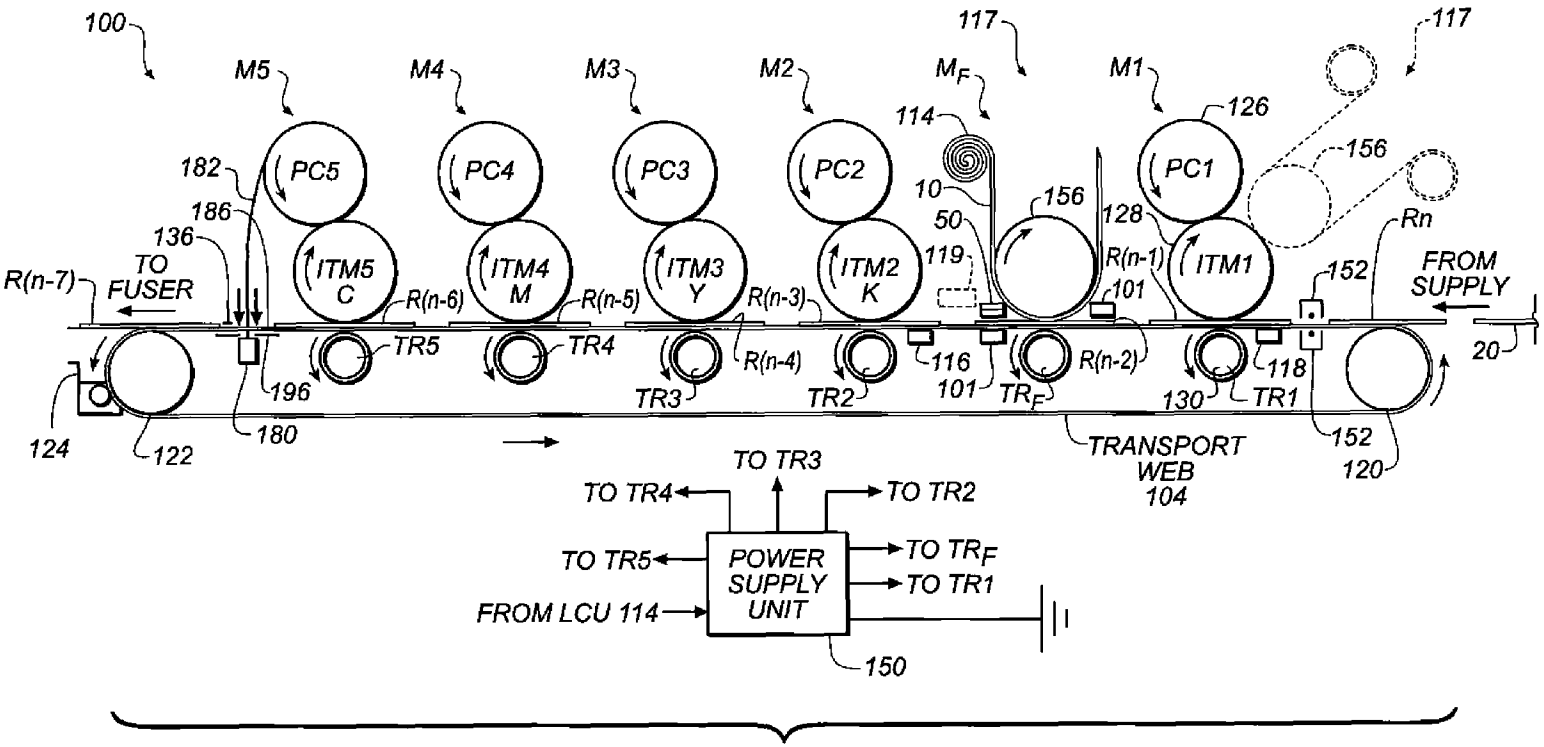
FIG. 3 is a schematic cross-sectional side view of another embodiment of the electrographic reproduction apparatus shown in FIG. 1.

In the embodiment shown in FIG. 1, thin film applicator 106 may apply thin film 30 on a thin film support 30B between printing module M5 and fuser roller 104. The toner, thin film 30 and/or receiving member 20(R) may be cooled (not shown) prior to the separation of the thin film support, possibly having some residue thin film, from receiving member 20(R). Registration marks 136 may be applied and used in conjunction to a color registration 180 prior to printing module M5 and corrections may then be made based on the data from the scanned registration marks 136 as shown in FIG. 3, so that the images created in M1-M5 are more accurately registered to thin film 30, as described in more detail below. A finishing sensor 116 as well as other optional thin film sensors 101 can be used to accurately register the thin film.

In the event the color toner is not fused before the application of thin film 30, it is important to stabilize the color image so it does not interfere with thin film 30 application process. In one embodiment, an ultraviolet (UV) curable color toner may be used for the non-film patterned image and for cross-linking this first toner before thin film 30 may be applied and fused to the toner. A cold stamping foil, such as the Kurz Alufin® foil, may be used. Alternatively the thin film patterned image can be laid down in an inverse manner to form a substantially negative image of the desired image that may facilitate preventing thin film 30 from adhering to receiver member 20(R) where the toner has been laid down and may enable the toner to be fused at the same time. In one embodiment, a wax-based toner may be used in such a process. In yet another embodiment, a hot stamping foil, such as, but not limited to, Kurz hot stamp foils, may be used in such a process.

A logic and control unit (LCU) 114 may be provided and may include a microprocessor incorporating suitable look-up tables and control software, which may be executable by LCU 114. The control software may be stored in a memory associated with LCU 114. Sensors 116 (shown in FIG. 3) associated with the finishing assembly 102 as well as the color registration sensor 180 and optional sensors 101 may provide appropriate signals to the LCU 114. In response to sensors 116, LCU 114 may issue commands and control signals that facilitate adjusting the heat and/or pressure within fusing nip 108 and otherwise generally nominalize and/or optimize the operating parameters and reduce errors which are attributable to the printing process and more particularly to the film application. Also, feedback from the sensors associated with the fusing and glossing assemblies may provide appropriate signals to the LCU 114. A film applicator device 117 can also have separate controls providing control over temperature of the application roller and the downstream cooling of the film and control of application nip pressure for the film applicator.

Figure 2:
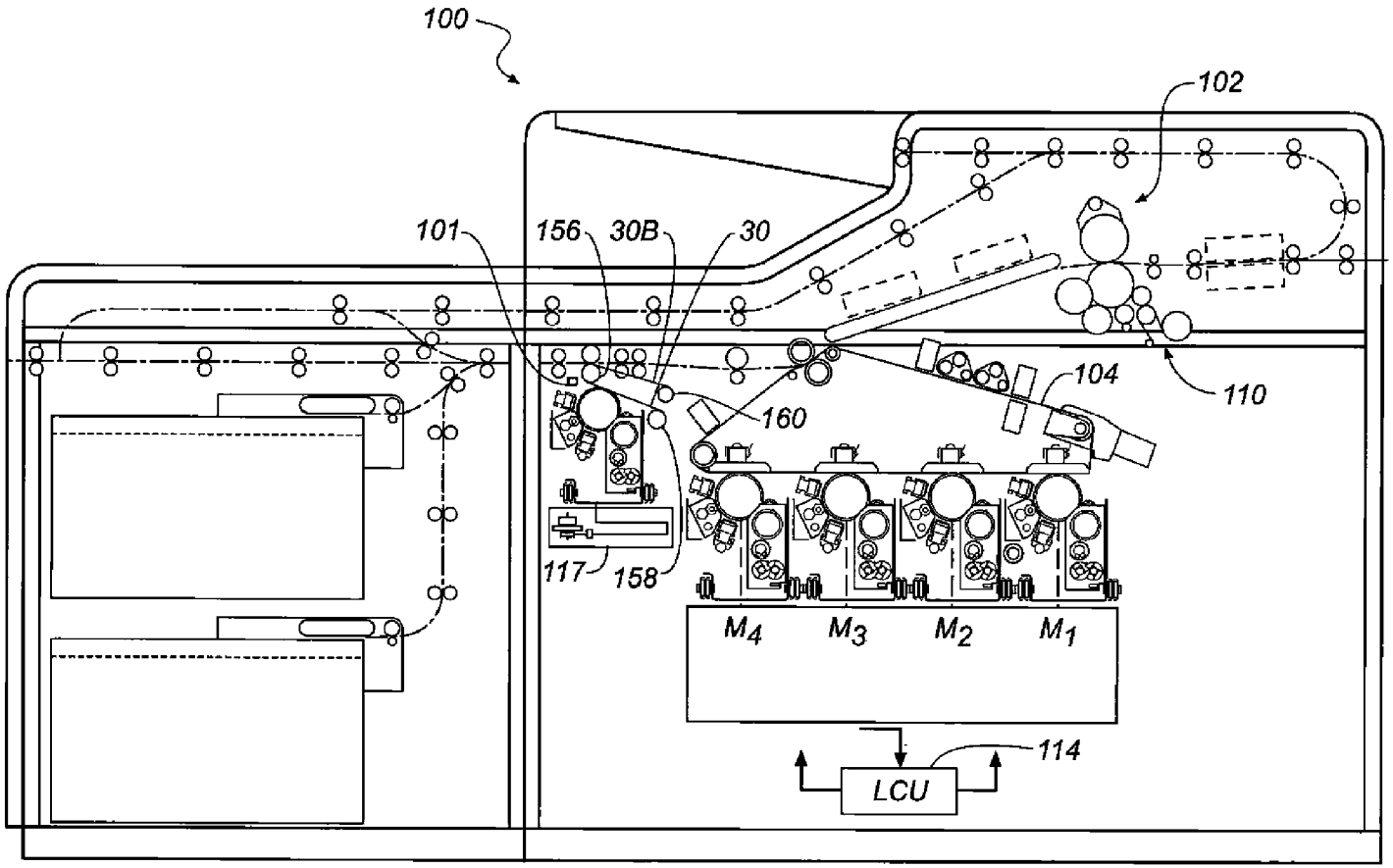
FIG. 2 is a schematic cross-sectional side view of another embodiment of the electrographic reproduction apparatus shown in FIG. 1.

The embodiment shown in FIG. 2 shows a first and a second automatic receiver member positioner that may use information from both one or more optional thin film registration sensors 101 and the color toner registration sensor 180 to control both the position and timing of the receiver member. Such control enables the thin film image to be registered to the color toner image that may be applied in the subsequent color toner transfer nip. The position adjustment adjusts for skew and cross-track alignment and the timing adjustment enables the receiver member to be delivered to the color toner transfer nip such that it is accurately registered in an in-track direction. The first automatic receiver member positioner may adjust the receiver such that the thin film image may be accurately registered to the receiver. Moreover, in-track, cross-track, and skew adjustments can be made.

FIG. 3 shows another embodiment for producing a thin metal film patterned print 50. In the exemplary embodiment, printing apparatus 100 may include printing modules M1-M5 and an additional metal film module $M_f$ all of which may be arranged in tandem along endless transport web 104. In the exemplary embodiment, metal film module $M_f$ may include thin film application device 117 and may be positioned between printing module M1 and printing module M2. Moreover, film module $M_f$ may include a cure lamp 119 positioned subsequent from thin film application device 117. Alternatively, metal film module $M_f$ be positioned subsequent the last printing module M5. In another alternative embodiment, metal film module $M_f$ may be positioned subsequent finishing assembly 102.

In the exemplary embodiment endless transport web 104 may be supported and driven by a pair of rollers 120 and 122. Moreover, a cleaning station 124 may be coupled to transport web 104 to facilitate cleaning thereof. At least one sensor 116 and at least one registration reference 118 may be positioned along transport web 104, as described in more detail below.

Figure 4:
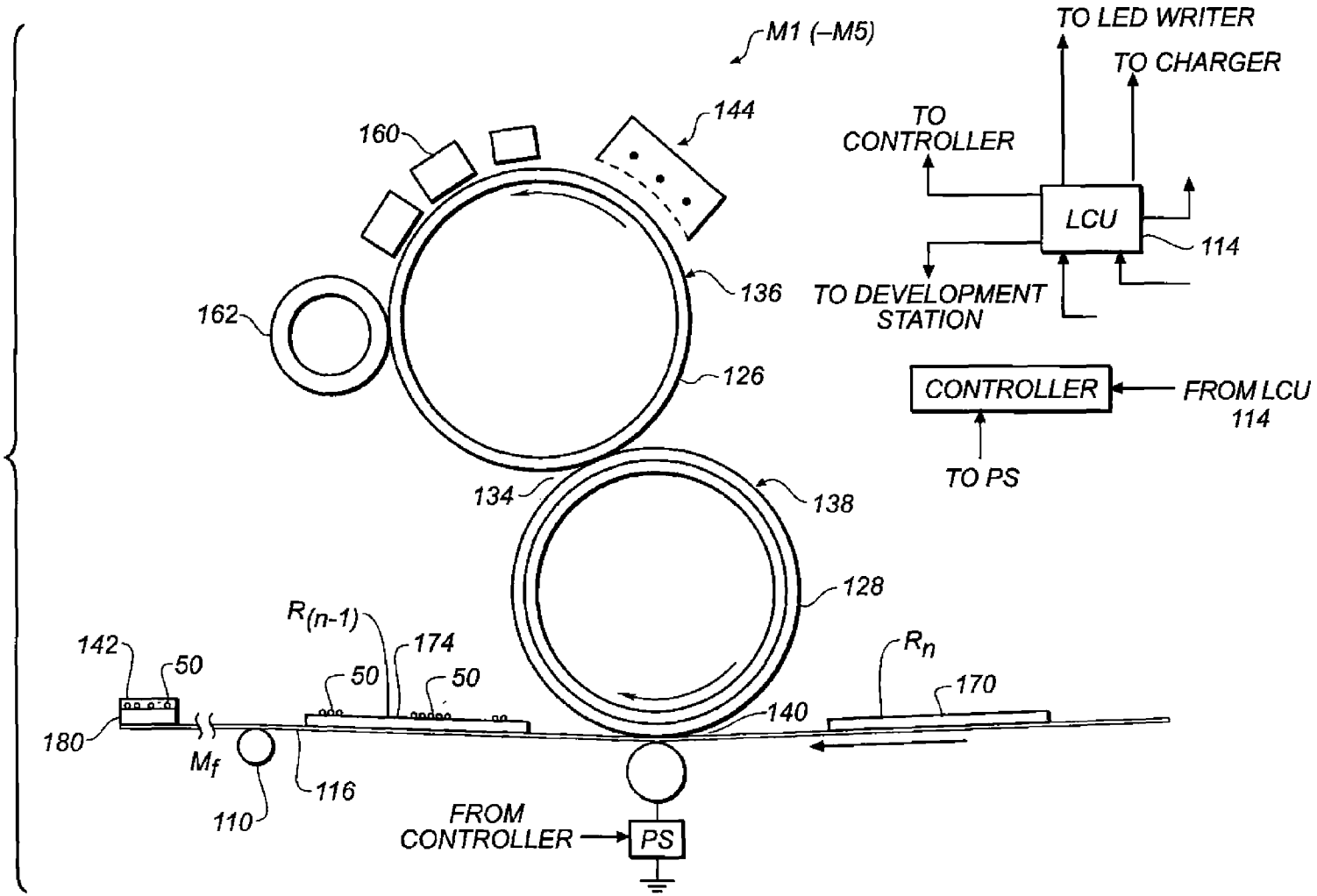
FIG. 4 is an enlarged schematic cross-sectional side view of one printing module that may be used with the apparatus shown in FIG. 1.

Printing modules M1-M5 may each include a respective photoconductive imaging roller PC1 126, PC2, PC3, PC4 and PC5; a respective intermediate transfer member roller ITM1 128, ITM2, ITM3, ITM4 and ITM5; and a respective transfer backup roller TR1 130, TR2, TR3, TR4, and TR5. FIG. 4 is a cross-sectional side schematic view of printing module M1. It should be understood that the structure of printing modules M2-M5 may be substantially similar to the following description of printing module M1. In the exemplary embodiment, printing module M1 may include photoconductive imaging roller PC1 126 that may be rotatably coupled to intermediate transfer member roller ITM1 128 such that a first transfer nip 134 may be defined between a surface 136 of photoconductive imaging roller PC1 126 and a surface 138 of intermediate transfer member roller ITM1 128. Moreover, intermediate transfer member roller ITM1 128 may be rotatably coupled to endless transport web 104, wherein transfer backup roller TR1 130 may also be rotatably coupled to endless transport web 104. Further, transfer backup roller TR1 130 may be positioned substantially adjacent intermediate transfer member roller ITM1 128 such that a second transfer nip 140 may be defined therebetween.

A power supply unit 150 provides individual transfer currents to the transfer backup rollers TR1, TR2, TR3, TR4, and TR5 respectively. Logic and control unit 114, as shown in FIG. 1, may provide control of the various components and process control parameters of the apparatus in response to signals from various sensors associated with the electrophotographic printer apparatus 100. Logic control unit 114 may also provide timing and control signals to the respective components to provide control of the in accordance with well understood and known employments.

During operation, intermediate transfer member 128 may transfer the respective layer (separation) image from the respective photoconductive imaging roller PC1 126 through first transfer nip 134 to surface 138 of the intermediate transfer member 128. Moreover, the image may be transferred from intermediate transfer member 128 to receiver member Rn, shown prior to entering second transfer nip 140 in FIG. 4, which may receive the respective (separation) images in superposition to form a composite image thereon. Receiver member R(n−1) is shown subsequent to the transfer of the multilayer (separation) image. Receiver member R(n−2) is shown subsequent to the transfer of thin film toner pattern and the thin film application device 117, shown here as a metal conductive film layer 142. As a result, a colored toner separation image can be created on the photoconductive imaging roller PC1 126, transferred to intermediate transfer member roller ITM1 128 and transferred again to receiver member 20(R) that may be moving through second transfer nip 140.

Printing module M1 may also include a plurality of electrographic imaging subsystems for producing one or more multilayered images or patterns. For example, in one embodiment, printing module M1 may include a primary charging system 144 that is operatively coupled to surface 136 of photoconductive imaging roller PC1 126, wherein primary charging system 144 may facilitate uniformly electrostatically charging surface 136. Moreover, printing module M1 may include an exposure subsystem 146 that may be operatively coupled to surface 136, wherein exposure subsystem 146 may facilitate image-wise modulating the uniform electrostatic charge by exposing photoconductive imaging member 126 to form a latent electrostatic multi-layer (separation) image of the respective layers. Printing module M1 may also include a development station subsystem 148 that may be operatively coupled to surface 136, wherein development station subsystem 148 may facilitate developing the image-wise exposed photoconductive imaging member 126.

During operation, receiver members R(n)-R(n−7), where n may be the number of printing modules or stations with printing apparatus 100, may be channeled from a paper supply unit (not shown) and transported through the printing modules M1-M5 and thin film module $M_F$ in a direction indicated. The receiver members may be coupled to endless transport web 104 electrostatically via coupled corona tack-down chargers 152. Receiver member Rn may be channeled from the supply source, such that receiver member Rn may pass over roller 120 prior to entering second transfer nip 140 of first printing module M1, in which the preceding receiver member R(n−1) is shown. Similarly, receiver members R(n−2), R(n−3), R(n−4), R(n−5) and R(n−6) are shown moving respectively through the transfer stations of printing modules M2, M3, M4, M5 and the thin film module $M_F$. An unfused image formed on receiver member R (n−7) is moving, as shown, towards finishing assembly 102 that may include a fuser, such as those of well known construction, and/or other finishing assemblies in parallel or in series, and can also include one or more additional thin film applicators 106 (shown in FIG. 1).

In the exemplary embodiment, printing module M1 may deposit clear toner; printing module M2 may deposit black (K) toner color separation images; printing module M3 may deposit yellow (Y) toner color separation images; printing module M4 may deposit magenta (M) toner color separation images; and printing module M5 may deposit cyan (C) toner color separation images. An optional printing module M6 (not shown) may form any color such as red, blue, green or any other fifth color separation image or even a gloss finish or another film. In this embodiment printer apparatus may include thin metal film module $M_F$ that may include a thin film application device 117 to contact a thin film 30 with receiver members 20(R), as described below. Thin film application device 117 may include a heated roller 156, a film supply roller 158 and a film capture roller 160. Thin film 30 may be in the form of a roll but could also be in sheet form where one sheet of a stack is used per print. The digitally patterned thin film print 50 described herein can be incorporated into multilayer structures in any of various configurations depending upon the requirements of the specific application. The digitally patterned thin film 30 can be applied on either or both sides of receiver member 20(R) or another support.

Figure 5A:
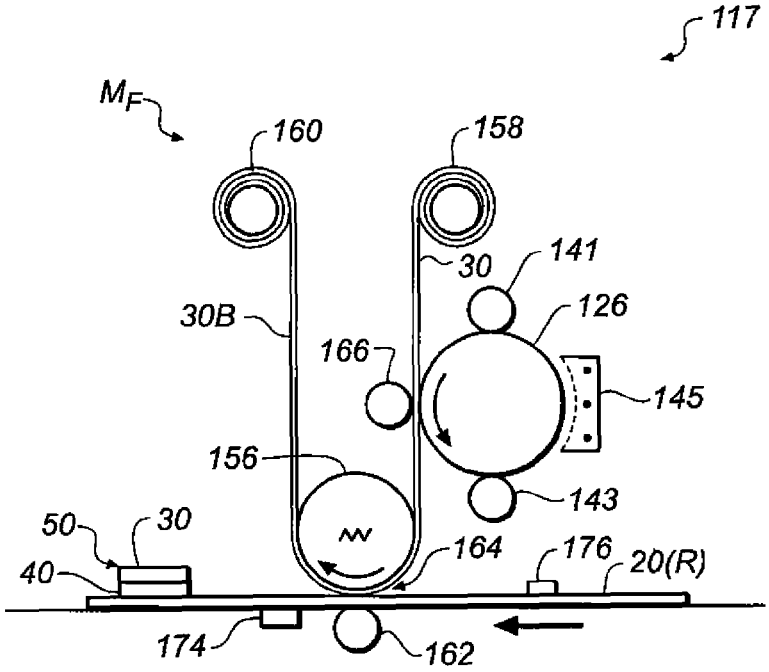
FIG. 5*a* is an enlarged schematic cross-sectional side view of a thin film module that may be used with the apparatus shown in FIG. 1.
Figure 5B:
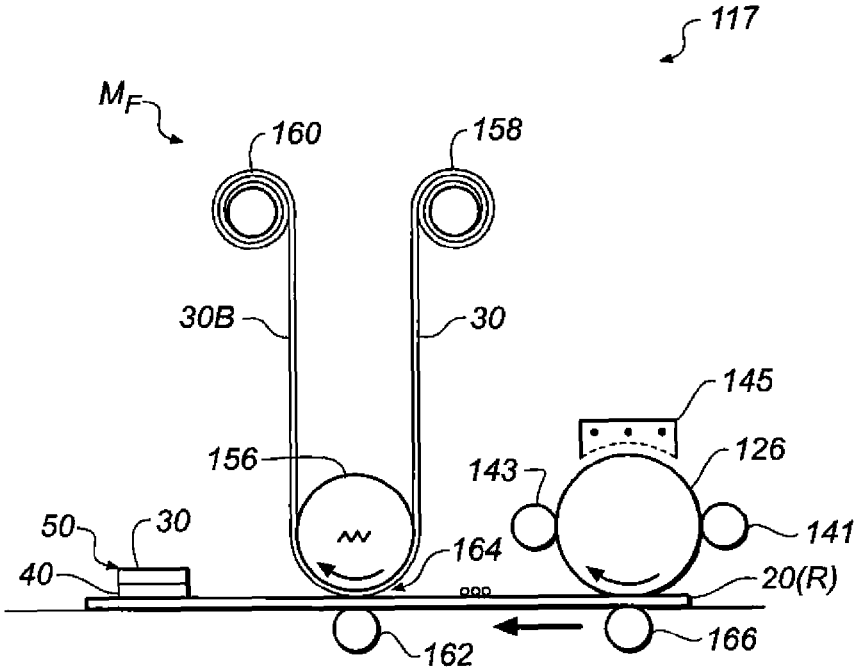
FIG. 5*b* is an enlarged schematic cross-sectional side view of another embodiment of the thin film module that may be used with the apparatus shown in FIG. 1.

FIGS. 5*a* and 5*b* show two embodiments of thin film application device 117, which may include thin film applicator 106. FIG. 5*a* is a cross-sectional side view of thin film applicator 106 that may include at least one heated roller 156. In one embodiment, roller 156 may be internally heated. Thin film applicator 106 may also include a film supply device that may have film supply roller 158 and film capture roller 160. Alternative embodiments may include a stamp machine and/or other thin film applicators. In the exemplary embodiment, heated roller 156 may be coupled to thin film 30. A pressure roller 162 may be rotatably coupled to heated roller 156 such that a nip 164 may be defined therebetween. Moreover, thin film applicator 106 may include a photoconductive roller 126 that may be coupled to thin film 30. Moreover, a back-up roller 166 may also be coupled to thin film 30 and positioned adjacent photoconductive roller 126. A toner roller 168, a cleaner 170 and a charger 172 may be coupled to photoconductive roller 126.

During operation, thin film material 30, or metal foil, may be drawn from film supply roller 158 by film capture roller 160. As the thin film material 30 passes photoconductive roller 126, a toner separation image may be created on photoconductive roller 126 and transferred to thin film material 30. Next, the thin film material 30 and toner separation image may be laid on a surface of receiver member 20(R) adjacent heated roller 156 at nip 164. After the thin film material 30 is applied, receiver member 20(R) may exit thin film application device 117. In one embodiment, the toner, thin film material 30 and/or receiver member 20(R) may be cooled by a cooler prior to the separation of thin film support from receiver member 20(R).

FIG. 5*b* is another embodiment of thin film application device 117. In this embodiment, photoconductive roller 126 may be positioned adjacent receiver member 20(R) such that photoconductive member 126 facilitates transferring a toner separation image to receiver member 20(R) prior to entering nip 164 of thin film applicator 106.

During operation, a toner separation image may be created on photoconductive roller 126 and transferred to receiver member 20(R). Moreover, thin film material 30, may be drawn from film supply roller 158 by film capture roller 160. As the thin film material 30 contacts receiver member 20(R), heated roller 156 facilitates heating a toner separation image such that the toner material becomes substantially adhesive and enables thin film material 30 to adhere thereto. After the thin film material 30 is applied, receiver member 20(R) may exit thin film module $M_F$. In one embodiment, the toner, thin film material 30 and/or receiver member 20(R) may be cooled by a cooler prior to the separation of thin film support from receiver member 20(R).

In the event the thin film application device 117 operates at a faster speed than other parts of the printer then a buffer can be used to accommodate any differences in speed. Optionally, other rollers can be added as needed to correct any positional problems, such as deskewing rollers (not shown). The thin film application device is preferably driven at the same operational speed as the printer. Completing the thin film application module is a sensor 174 that issues a signal to LCU 114 upon the passage of the trailing edge of the receiver 20 and also controls registration by use of one or more registration marks 176.

During operation, embossed images may first be laid on receiver members 20(R). In such an operation, subsequent to the transfer of the five color toner separation images in superposed relationship to each receiver member 20(R), receiver member 20(R) may be serially de-tacked from transport web 104 and sent in a direction towards the finishing assembly 102 to fuse or fix the dry toner images to receiver member 20(R). Transport web 104 may then be reconditioned for reuse by cleaning and providing charge to both surfaces, which may facilitate neutralizing the charge on the opposed surfaces of transport web 104.

The electrostatic image may be developed by the application of pigmented marking particles (toner) to the photoconductive imaging roller 126 by the respective development station 148. Each of the development stations of the respective printing modules M1-M5 may be electrically biased by a suitable respective voltage to develop the respective latent image. In one embodiment, the voltage may be supplied by a power supply or by individual power supplies (not shown). In another embodiment, the respective developer may be a two-component developer that may include toner marking particles and magnetic carrier particles. Each color development station may have a particular color of pigmented toner marking particles associated respectively therewith for toning. Thus, each of the five modules may create a different color marking particle image on the respective photoconductive imaging roller 126. As will be discussed further below, a non-pigmented (i.e., clear) toner development station may be substituted for one of the pigmented developer stations so as to operate in similar manner to that of the other printing modules, which deposit pigmented toner. The development station of the clear toner printing module may have toner particles associated respectively therewith that are similar to the toner marking particles of the color development stations but without the pigmented material incorporated within the toner binder.

With further reference to FIG. 1, endless transport web 104 may transport the toner image carrying receiver members 20(R) to a finishing assembly 102, which may fix the toner particles to the respective receiver members 20(R) by the application of heat and pressure. In one embodiment, finishing assembly 102 may also include a release fluid application substation that may apply release fluid, such as, for example, silicone oil, to fusing roller 108. Receiver members 20(R) carrying the fused image may be transported seriatim from the finishing assembly 102 along a path to either a remote output tray or may be returned to the image forming apparatus to create an image on either the backside or the front side of receiver member 20(R).

Image data for writing by the printer apparatus 100 may be processed by a raster image processor (RIP) (not shown), which may include a color separation screen generator or generators. The output of the RIP may be stored in frame or line buffers for transmission of the color separation print data to each of respective LED writers K, Y, M, C, and R (which stand for black, yellow, magenta, cyan, and red respectively and assuming that the fifth color is red). The RIP and/or color separation screen generator may be a part of the printer apparatus or remote therefrom. Image data processed by the RIP may be obtained from a color document scanner or a digital camera or generated by a computer or from a memory or network which typically includes image data representing a continuous image that needs to be reprocessed into halftone image data in order to be adequately represented by the printer. The RIP may perform image processing processes including, but not limited to, color correction, etc. to facilitate obtaining the desired color print. Color image data may be separated into the respective colors and converted by the RIP to halftone dot image data in the respective color using matrices, which may include the desired screen angles and screen rulings. The RIP may be a suitably programmed computer and/or logic devices and may be adapted to employ stored or generated matrices and templates for processing separated color image data into rendered image data in the form of halftone information suitable for printing.

Figure 6:
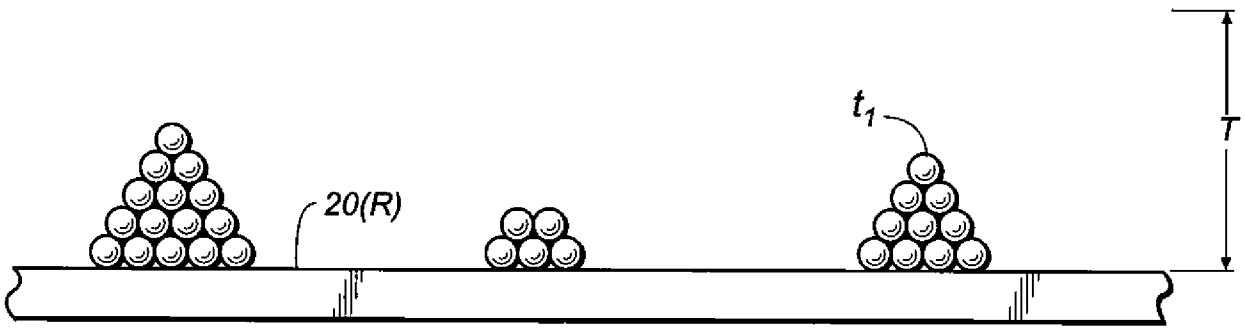
FIG. 6 is a schematic cross-sectional side view of a receiver member having a marking print image formed thereon that includes layers having variable height to form raised information.
Figure 7:
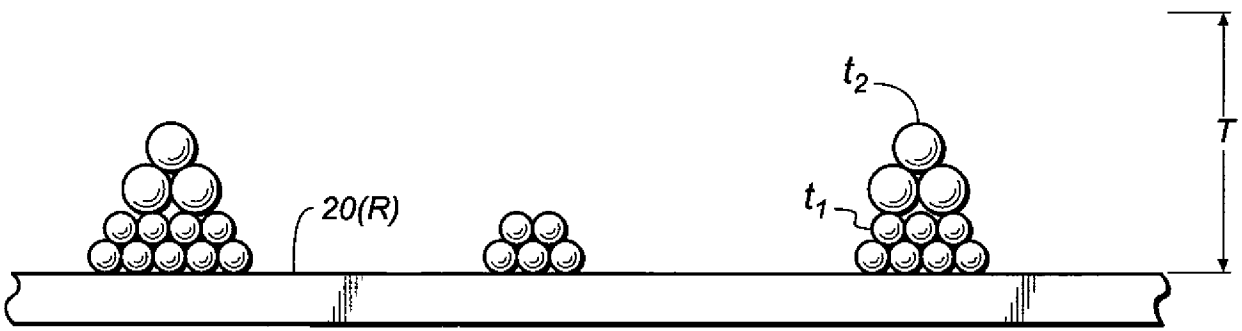
FIG. 7 is a schematic cross-sectional side view of a receiver member having a marking print image formed thereon that includes marking particles that have variable sizes and diameters to form raised information.
Figure 8:
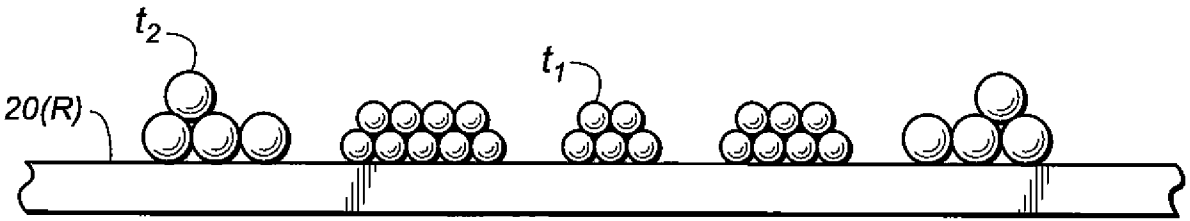
FIG. 8 is a schematic cross-sectional side view of a receiver member having a marking print image formed thereon that includes marking particles that have variable sizes and diameters to form raised information.

The process of printing raised letter information, with a resultant tactile feel, will now be described with reference to FIGS. 6-8. This process can be accomplished with an electrographic reproduction apparatus, such as the printer apparatus 100 discussed above in FIGS. 1-5 by controlling the stack height T of toner particles t on a receiver member 20(R), as shown in FIGS. 6-8. The raised letter information can have various applications such as, for example, providing foreground or primary images, such as, but not limited to, Braille symbols, producing high quality printing such as stationary or business cards, giving documents a security feature, or providing background to images, such as desired surface characteristics for receiver members.

When printing raised information, especially when a substantially different size toner particle, having different diameters or other variations, set is provided, in one electrographic module it may be advantageous to alter one or more electrographic process set-points, or operating algorithms, to optimize performance, reliability, and/or image quality of the resultant print. Examples of electrographic processes set-point (or operating algorithms) values that may be controlled in the electrographic printer to alternate predetermined values when printing raised information may include, but not limited to, fusing temperature, fusing nip width, fusing nip pressure, imaging voltage on the photoconductive member, toner particle development voltage, transfer voltage and transfer current. In the exemplary embodiment, to facilitate printing raised information using apparatus 100, a special mode of operation may be provided where the predetermined set-points (or control parameters or algorithms) are used when printing the raised information. For example, when the electrographic printing apparatus prints non-raised information images, a first set of set-points/control parameters may be utilized. Then, when the electrographic printing apparatus changes mode to print raised information images, a second set of set-points/control parameters may be utilized.

The basic premise for producing foreground raised information with a tactile feel is that the selected information can exhibit the desired tactile feel when the toner particle stack height T is at least about 20 μm. In one embodiment, the stack height T can be produced by selectively building up layer upon layer of toner particles t1 of a standard general average mean volume weighted diameter of less than 9 μm, where each layer has a lay down coverage of about 0.4 mg/cm$^2$ to about 0.5 mg/cm$^2$ (see FIG. 7). When referring to toner particles, the toner size or diameter is defined in terms of the mean volume weighted diameter as measured by conventional diameter measuring devices such as a Coulter Multisizer, sold by Coulter, Inc. The mean volume weighted diameter is the sum of the mass of each toner particle multiplied by the diameter of a spherical particle of equal mass and density, divided by the total particle mass.

In one embodiment, the volume average toner size of the toner image may be greater than 14 μm. In another embodiment, the volume average toner size of the toner image may be greater than about 20 μm and less than about 30 μm. In yet another embodiment, at least one toner image may be produced with a volume average size that is less than about 9 μm and at least one other toner image that has a volume average size that is greater than about 14 μm.

Alternatively, several layers of the standard size toner particles t1 can be selectively covered in the desired raised information location with layers of toner particles t2, of a larger general average mean volume weighted diameter of about 12 μm to about 30 μm (see FIG. 8). In one embodiment, the larger toner particles may be clear (i.e., not pigmented) and have a lay down coverage of at least 2 mg/cm$^2$. Using small marking particles for the non-raised image is preferred because it allows for high quality images even when the large clear particles are deposited on top.

In one embodiment, the height of the thickest region of the toner image after the fusing, or fixing step, may be about two times the height of the thinnest region of the toner image after the fusing step. In another embodiment, the height of the thickest region of the toner image after the fusing step may be about five times the height of the thinnest region of the toner image after the fusing step. In yet another embodiment, at least two toner images may be deposited on receiver member 20(R), wherein at least one of the toner images may be at least two times greater in volume average size than the volume average size of at least one other toner image.

The raised print can also be used to impart a desired, more overall background texture to the image, as described in U.S. Pat. No. 7,468,820 issued Dec. 23, 2008, in the names of Yee S. Ng et al. For example, using variable data from a database for the raised information enables the variable data printing of tactile images wherein the background texture may, for example, provide the appearance of, but not limited to, a painter's canvas, an acrylic painting, a basketball (pigskin), sandstone, sandpaper, cloth, carpet, parchment, skin, fur and/or wood grain. In one embodiment, the resultant texture may be periodic. Alternatively, the resultant texture may be random or unique.

It may also be desirable to create textures with a low frequency screening algorithm. In one embodiment, the screen frequency of one or more toner images may be less than about 160 lines per inch.

Variable data may be used, for example from a suitable database, for the raised information which enables each printed page to contain unique information, with its own particular tactile feel. In order to improve reproduction of the colors in areas containing raised image effect, it may be desirable to build a new color profile based on the raised information.

There are several ways in which fifth image data may be generated for raised printing. In one embodiment, the fifth module image data can be generated by the digital front end (DFE) from original CMYK color data that uses the inverse mask technique of U.S. Pat. No. 7,139,521, issued Nov. 21, 2006, in the names of Yee S. Ng et al. The inverse mask for raised information printing may be formed such that any rendered CMYK color pixel value with zero marking values may have a full strength (100%) fifth module pixel value generated. The fifth module image data may then be processed with a halftone screen that renders a special texture. Accordingly, a special raised texture appearance may occur everywhere on the image (i.e., the foreground) where there is CMYK toner, but not in the background area.

In one alternative embodiment, a DFE can be utilized to store objects type information, such as text, line/graphics, image types to each rendered CYMK color pixels during raster image processing (RIPping). The fifth module imaging data may then be generated according to an operator's request to certain types of objects. For example, when only text object type is requested, the DFE may generate fifth image data only on the text object, while other object types may have zero values. This fifth image pixel may then be screened with halftone screens to generate the desired special texture. Here, the special raised texture may appear on the text objects while other objects may be normal (non-textured) in appearance.

In another alternative embodiment, the operator selected fifth image spot with special texture appearance may be formed on top of CMYK/RGB image objects. The DFE renders fifth channel image data accordingly and sends the data to the press for printing. A special halftone screen (for example, a contone screen) in the press may be configured to screen the fifth image data. As a result, the special texture may be printed with a raised appearance that conforms to the operator's choice.

In the above-described embodiments and as shown in FIGS. 6-8, a clear toner may be applied on top of a color image to form a three-dimensional texture. It should be understood that texture information corresponding to the clear toner image plane need not be binary. In other words, the quantity of clear toner called for, on a pixel-by-pixel basis, need not only assume either 100% coverage or 0% coverage, rather it may call for intermediate "gray level" quantities, as well.

In an area of the colored image to be covered with a clear toner for three-dimensional texture, the color may change due to the application of the clear toner. In such an embodiment, two color profiles may be created. A first color profile may be for 100% clear toner coverage on top, and a second color profile may be for 0% clear toner coverage on top. On a pixel-by-pixel basis, proportional to the amount of coverage called for in the clear toner image plane, a third color profile may be created that interpolates the values of the first and second color profiles. Thus, a blending operation of the two color profiles may be used to create printing values. In one embodiment, a linear interpolation of the two color profile values corresponding to a particular pixel may be performed. It should be understood, however, that some form of non-linear interpolation may be used instead. This technique is especially useful when the spatial frequency of the clear toner texture is low.

The second approach may be used when the spatial frequency of the clear toner texture is high. In such case, only one color profile may be needed for that textured image. One option may be to use the ICC color profile of the original system for all textures, i.e., the ICC color profile that assumes there is no clear toner. In such an embodiment, the appearance of the colored image may change slightly since the absolute color may differ from the calibrated color. However, there may not be an observable color difference within a uniform color region, even though the color is not quite accurate. A second option may be to build a new ICC color profile with that particular three-dimensional clear toner texture surface. In this manner, the macro "color accuracy" problem may be corrected, while the color artifact from pixel-to-pixel is not noticeable. Furthermore, a library of such texture-modified ICC color profiles may be built up over time for use whenever an operator wishes to add a previously defined texture to a profile, as discussed above. A computer software application implementing such a system may, for the second approach, automatically invoke just one of these two options, or may instead display a choice of the two options to an operator, perhaps with one of the options being the default.

The process of applying a thin metal foil, or thin film, to the embossed image, or toner adhesive, will now be described. In the exemplary embodiment, the thin film may be applied using thin film module $M_F$. Thin film module $M_F$ may be positioned between printing module M1 and printing module M2 as shown in FIG. 3. In another embodiment, thin film module $M_F$ may be position subsequent finishing assembly 102, and more specifically, fuser roller 108. As a result, in one embodiment, a digitally patterned thin film print 50 may be produced by coupling the thin film layer 30 to the toner adhesive coupled to receiver member 20(R) prior to fusing. In an alternative embodiment, the digitally patterned thin film print 50 may be produced by coupling the thin film layer 30 to the toner adhesive that is coupled to receiver member 20(R) after the initial fusing of the toner adhesive. In such and embodiment, receiver member 20(R) may have a plurality of toners applied thereto using printing modules M1-M5, have the toner fixed to receiver member 20(R) using finishing assembly 102 and have a thin film applied to the fixed toner adhesive using thin film module $M_F$ after receiver member 20(R) exits finishing assembly 102. In one embodiment, the thin film may have a thickness that is less than about 1 μm, which can be adhered to the thin film toner adhesive.

In one embodiment, the toner used as the thin film toner adhesive may be the embossed image, or raised information, as described above. In another embodiment, the toner used as the thin film toner adhesive can be the Kodak EP toner or Kodak chemically prepared dry ink (CDI). In such an embodiment, the toner used to form the final thin film pattern layers can be styrenic (styrene butyl acrylate) type used in toner with a polyester toner binder. In another embodiment, the refractive index of the polymers used as toner resins may be about 1.53 to about 1.102. Generally, the refractive index of the polyesters may be about 1.54 and the refractive index of the styrenic resins may be about 1.59. One skilled in the art would understand that other similar materials could also be used. Electrographic (EP) marking particles can be deposited in accordance with an image pattern on a receiver thin film surface to define the electrode pattern after development. The phrase "electrographic marking particles" is used herein broadly to include electrically photosensitive particles that may be used in migration imaging processes and any other material used to develop and define an electrographic image pattern such as, for an example, electrographic toners, liquid droplets, resins or polymer particles. Such marking particles may be a composite particle and may contain a colorant.

The marking particle, or toner, may be brought into contact with the image pattern in an electrographic developer composition that may include a carrier vehicle and the marking particle. The phrase "electrographic developer composition" may include a composition that may have a carrier and the electrographic marking particles of the present invention, which may be intended for use in developing electrographic image patterns, including but not limited to, the methods of electrophotographic, electrophoretic migration imaging and modulated electrostatic printing. In general, the novel electrographic marking particles of the present invention can be used to imagewise deliver a desired concentration of the conductivity modifier independent of how the image pattern is formed if the image pattern is developed with marking particles.

The thin film layer(s) of this invention are patterned by application of one of more toners using the electrographic development process. In one embodiment, the toners used herein may include particles that may vary in size and diameter to facilitate printing raised information, as described previously. In another embodiment, the toners used herein may use electrographic marking toner particles as described in U.S. Pat. No. 5,948,585 hereby incorporated by reference. Some of these limited coalescence techniques used to prepare CDI are described in patents pertaining to the preparation of electrostatic toner particles because such techniques typically result in the formation of toner particles having a substantially uniform size and uniform size distribution. Representative limited coalescence processes employed in toner preparation are described in U.S. Pat. Nos. 4,833,018 and 4,965,131, hereby incorporated by reference. In one example, a pico high viscosity toner, of the type described above, could form the first and or second layers and the top layer could be a laminate or an 8 micron clear toner in the fifth station thus the highly viscous toner would not fuse at the same temperature as the other toner.

In the coalescence techniques described, the selection of toner additives such as, but not limited to, charge control agents and pigments, may facilitate controlling the surface roughness of toner particles by taking advantage of the aqueous organic interphase present. In one embodiment, toner additives employed for this purpose that may be highly surface active or hydrophilic in nature, may also be present at the surface of the toner particles. Particulate and environmental factors that are important to successful results may include a toner particle charge/mass ratios (it should not be too low), surface roughness, poor thermal transfer, poor electrostatic transfer, reduced pigment coverage and environmental effects such as, but not limited to, temperature, humidity, chemicals, radiation and the like that may affect the toner or receiver member. Such environmental factors should be controlled and kept within normal operating range because of their effects on the size distribution. In one embodiment, the toner may have a tensile modulus ($10^3$ psi) of about 150 to about 500, normally about 345, a flexural modulus ($10^3$ psi) of about 300 to about 500, normally about 340, a hardness of about M70 to about M72 (Rockwell), a thermal expansion of about 68 to about 70 $10^{-6}$/degrees Celsius, a specific gravity of about 1.2 and a slow, slight yellowing under exposure to light according to J. H. DuBois and F. W. John, eds., in Plastics, $5^{th}$ edition, Van Norstrand and Reinhold, 1974 (page 522).

Each receiver member 20(R) may be fused using either a contact finishing method or a non-contact finishing method. Contact and non-contact finishing methods may include, but not limited to, heat, pressure, chemical, infrared (IR) and/or UV. In one embodiment, contact fusing may be used to facilitate faster turnaround times as compared to non-contact finishing. Moreover, in contact finishing the speed of fusing and resident times and related pressures applied may be important to achieve the particular final desired film layer. In one embodiment, the described toner normally has a melting range between about 50 to about 150 degrees Celsius. An example of two types of toners that enable the digitally patterned foil to adhere thereto may include toner that may be heated to a temperature close to the softening point (i.e. Tg) and/or may have a relatively high molecular weight, such as the Kodak MICR toner. Toner that has a higher molecular weight and a high cohesive strength may maximize the adhesive force between the substrate and the thin film when the toner is in a melt state. Surface tension, roughness and viscosity should be such as to yield an efficient transfer. Surface profiles and roughness can be measured using the Federal 5000 "Surf Analyzer" and may be measured in regular units, such as microns. Toner particle size, as discussed above, may also be important since larger particles not only result in the desired heights and patterns but also may result in a clearer thin film pattern layers since there is less air inclusions, normally, in a larger particle. Color density may be measured under the standard CIE test by Gretag-Macbeth in colorimeter and is expressed in L*a*b* units as is well known. The CIE is also known as the CIELAB, whose coordinates are actually L*, a*, and b*. The color spaces are related in purpose, but differ in implementation. These color spaces CIE and CIELAB are derived from the same "master" space CIE 1931 XYZ color space. Toner viscosity may be measured by a Mooney viscometer. In one embodiment, high viscosities may facilitate preserving the thin film pattern layer's pattern, which can result in greater height. The higher viscosity toner may also result in a retained form over a longer period of time.

In one embodiment, a glass transition temperature (Tg) may be about 50 to about 100 degrees Celsius. In an alternative embodiment, the glass transition temperature (Tg) may be about 118 degrees Celsius. Permanence of the color toner and/or the clear toner under UV and IR exposure can be determined as a loss of clarity over time. Generally, the lower this loss is, the better the result. Clarity, or low haze, may be important for thin film pattern layers that are transmissive or reflective wherein clarity may be an indicator and haze may be a measure of higher percent of transmitted light. When no cooling device is used prior to the separation of the thin film support from the substrate the toner preferably has a high cohesive strength when in the melt state to maximize its adhesive force to the thin film.

In another embodiment, a method may be provided for patterning a thin film that may include the steps of: (a) developing a toner image on to a charge pattern with a development station that may include a photoconductive image roller and toner adhesive; (b) transferring the toner image to a receiver member, such as paper, with heat and/or pressure to enable a patterned electrically-conductive thin film layer to be adhered to the toner; and (c) transferring a thin metal film to the toner adhesive image pattern with a set of heated pressure rollers to facilitate an imagewise interaction between thin film electrode layer and the toner adhesive. In one embodiment, the first layer, if the thin film is laid down first, can be cooled before applying one or more color layer to minimize and image defects due to heat.

Moreover, the method can be used to form a thin film pattern, such as an electrode pattern, by an electrographic imaging process. The process may be an in-line process performed by printer apparatus 100 that may include the steps of: (a) depositing one or more layers of one or more thin film adhesive toners pixel-by-pixel applied as a mask of the desired foil image using a clear toner clear or alternatively using an inkjet printer head to perform this first step; (b) applying a thin film layer in registration, as described in more detail below, over the deposited adhesive toner using a hot roller to apply heat. In one embodiment, a cold stamp foil may be used in this process since there is heat that will be applied during the process and the toner will act as an adhesive so no additional supplied adhesive is required as is supplied with the so called "hot stamp foils".

In yet another embodiment, a method for producing textured thin film images on receiver members 20(R) may include the steps of: (a) depositing one or more toner images to form a predetermined adhesive image with more than one level of height; and (b) applying and fixing a foil to at least a portion of the adhesive image to create a textured thin film image. Moreover, this method may also include depositing an additional one or more toner images after the fixing step, wherein the additional one or more toner images may be deposited on top of the thin film layer, or foil. Further, this method may also include adhering the thin film layer, or metal foil, to both high and low areas of the one or more toner image. In one embodiment, the thin film layer may adhere primarily to the high areas of the one or more toner images.

In one embodiment, the toner may be UV curable and cured with a lamp shining from the center through the film to cure the adhesive toner as discussed above. The fixing steps may include: (c) applying heat an/or pressure or other means, such as UV, to adhere the thin film at desired locations and optionally (d) depositing, in register, the digitally patterned thin film image and one or more additional layers of one or more other colored toners over the adhered thin film layer, wherein the toner may be substantially identical to the first toner; and fixing the final print.

Registration is controlled, as described below in more detail, between the color toner lay down for colored images and the thin film patterned toner image to adhere the thin film. In one embodiment, the colored toner may be a clear toner having various characteristics. The registration of the colored toner layers to the digitally patterned thin film image can be further improved by using feed forward and or feed back algorithms based on sensors that measure the location of the endless transport web and imaging elements in time and/or characterize the printing system in a mode prior to the printing mode. Algorithms that compensate for factors that cause the position of the receiver member to be altered can be used to accurately register the subsequent toner images to the digitally patterned thin film image. Alternatively, when a common endless transport web is not used for printing the digitally patterned thin film image and the subsequent toner images, marks can be printed on the receiver member when the digitally patterned thin film image is created. These marks are read with sensors and used to accurately control the printing of the subsequent toner images. Another improvement to aid in registering the images may be to accurately measure the position of the receiver member by detecting the location of one or more edges of the receiver member at specified locations. Edge detection can be used with any of the described techniques.

This method can use conductive metal films and produce electronic circuits and/or any metal or other films to produce desired decorative images including scratch-offs. The film can produce embossed items and can use raised clear toner to give height (see FIGS. 5*a* and 5*b*).

In one embodiment, marking toner(s) may be applied on top of the digitally patterned thin film image. In such an embodiment, the toner(s) may not be opaque such that a metallic color image is created. Thus the final image (after the final fusing step) may contain a layer, or a plurality of layers, of transparent or semi-transparent ink layers that allow the reflective properties of the digitally patterned thin film image to be visualized. This method enables a wide variety of metallic colors to be created. An optional glossing step can also be used to produce a glossy decorative image. In one embodiment, higher gloss marking images on top of the digitally patterned thin film image produce more luster and therefore using an in-line or off-line finishing step to create a glossier image may be a preferred mode.

Another method for forming a thin film pattern, such as an electrode pattern, by an electrographic imaging process is off-line. This method may include the steps of: (a) depositing one or more layers of one or more thin film adhesive toners pixel-by-pixel applied as a mask of the desired foil image preferably using a clear toner such as in a single color machine like the Kodak Digimaster or alternatively using an inkjet printer head to perform this first step, and (b) depositing registration marks using the toners or ink, (c) applying the thin film and (d) applying heat an/or pressure or other means, such as UV, to adhere the thin film at desired locations, (e) in a separate device (an off-line device) the registration marks may be scanned and used to register the image to additional toner layers as described in the in-line process above.

This method can use conductive metal films and produce electronic circuits and/or any metal or other films to produce desired decorative images including scratch-offs. The film can produce embossed items and can use raised clear to give height and could be used in conjunction to the first method for more options.

In one embodiment a method of printing a digitally patterned thin film image with an in-line process may include using a non-adhesive toner that incorporates a release agent such as wax or may be cross-linkable when exposed to UV light. This method may include the steps of: (a) depositing one or more layers of one or more non-adhesive toners; (b) depositing one or more layers of one or more non-adhesive toners pixel-by-pixel applied in an inverse mask or negative image of the desired foil image (preferably clear and last) and cross-linking the toner with a UV light in the case where a curable toner is used; (c) applying a thin film layer over the image in the areas where no toner is present; and (d) fusing by applying heat and/or pressure or UV to adhere the thin film at desired locations but not where the non-adhesive toner was applied to produce the desired image; and optionally depositing a top layer over said desired image. In this embodiment an inverse mask of the final desired thin film pattern may be laid down as the non-adhesive toner. The thin film non-adhesive negative image may be formed by similar methods described for an inverse mask in U.S. Pat. No. 7,340,208, which is incorporated by reference.

As described herein a clear toner can be deposited so that the clear toner forms the negative image when the inverse mask mode is selected for the fifth image-forming module M5 in accordance with the information for establishing or printing a negative in clear toner in the referenced application. Image data for the clear toner negative may be generated in accordance with paper type and the pixel-by-pixel locations as to where to apply the clear toner. Information regarding the multicolor image is analyzed by a Raster Image Processor (RIP) associated with the LCU 114 to establish, on a pixel-by-pixel basis, where pigmented toner may be located on the thin film printed patterned receiver member. Pixel locations having relatively large amounts of pigmented toner are designated as pixel locations to receive a corresponding lesser amount of clear toner so as to balance the overall height of pixel locations with combinations of pigmented toner and clear toner. Thus, pixel locations having relatively low amounts of pigmented toner are provided with correspondingly greater amounts of clear toner. In the printing of the clear toner as a negative, the negative image data may be processed either as a halftone or continuous tone image. In the case of processing this image as a halftone, a suitable screen angle may be provided for this image to reduce moire patterns.

In another embodiment, a method of printing a digitally patterned thin film image with an in-line process that may use a non-adhesive toner that may incorporate a release agent such as wax or may be cross-linkable when exposed to UV light may include the steps of: (a) depositing one or more layers of one or more adhesive toners; (b) depositing one or more layers of one or more non-adhesive toners pixel-by-pixel applied to the desired foil image (preferably clear and last) and cross-inking the toner with a UV light in the event a curable toner is used (c) applying a thin film layer over the image in the areas where adhesive toner is present; and (d) fusing by applying heat and/or pressure or UV to adhere the thin film at desired locations but not where the non-adhesive toner was applied to produce desired image; and optionally depositing a top layer over said desired image. In this embodiment, the negative of the final desired thin film pattern may be laid down as the non-adhesive toner.

An important aspect of the process is the accurate registration process. In the registration process of the printer apparatus 100 each receiver member may include at least one register mark, such as per color printing unit, of the multi-color printing machine. The registration mark may be produced and assigned to each receiver member and defined with respect to its position relative to one of the marks themselves. For example, in an in-line film application, the receiver member may remain in registration throughout the process of color toner lay down, thin film application and fusing. In such an embodiment, one sensor for the toner registration relative positions may be used. In another embodiment, more than one sensor may be used to monitor other registration concerns. The marks may be applied to a support for the sheets and preferably downstream of the respectively associated receiver member. Moreover, the registration marks may be based on the determination of the position of the register marks of a receiver member using various methods, for example a circumferential register where at least one receiver member is controlled when the receiver member following the receiver member associated with the determined register marks are downstream in the printing process, as described in U.S. application Ser. No. 11/577,675 filed Apr. 20, 2007 and U.S. application Ser. No. 11/847,868 filed Aug. 30, 2007, each of which are incorporated by reference.

In one embodiment, the printing method for producing a registered thin film digitally patterned image on a receiver member may include the steps of depositing a digitally patterned layer of toner to form a predetermined adhesive image that represents a thin film digitally patterned image that may include applying one or more marks to the support for said sheets downstream of the respectively associated first receiver member and applying at least one register mark for the first receiver member that is to have a thin film applied thereto and defined with respect to the register mark position on the support, monitoring a thin film registration (application position) by analyzing the relative positions of the receiver member register marks and the thin film register marks, controlling the printing process by correcting the thin film registration using a position controller responsive to thin film registration, applying the thin film layer over the digitally patterned image layer an a receiver member based on the thin film registration, and activating the digitally patterned image layer to adhere said thin film layer to create said thin film digitally patterned image by applying heat and/or pressure to adhere the thin film at desired locations. This method can be modified by determining if there is a systematic drift and introducing a correction factor in a control step. The method may be modified in the event a weighting would improve registration. In such an event, using a weighting factor that may be increased by an increase of the elapsed time ($\Delta t$) between a current first control step (i) and a previous control step (i−1).

In another embodiment, printer apparatus 100 may control registration in the printer apparatus 100 during the printing process that may print four or more colors as well as the thin film application, wherein each receiver member may include at least one register mark per color printing unit of the multicolor printing machine. Moreover, each registration mark may be assigned to the receiver member and defined with respect to its position relative to one of the color marks themselves. These marks may be applied to a support, such as endless transport web, for the sheets and may be positioned downstream of the respectively associated receiver member. Moreover, the registration marks may be based on the determination of the position of the register marks of a receiver member using various methods, for example a circumferential register where at least one receiver member is controlled when the receiver member following the receiver member associated with the determined register marks are downstream in the printing process. The printer apparatus 100 may include at least one monitoring and control arrangement to facilitate detecting register marks, determining at least relatively the positions of said register marks and controlling the color printing units based on the aforementioned register mark positions.

Figure 9:
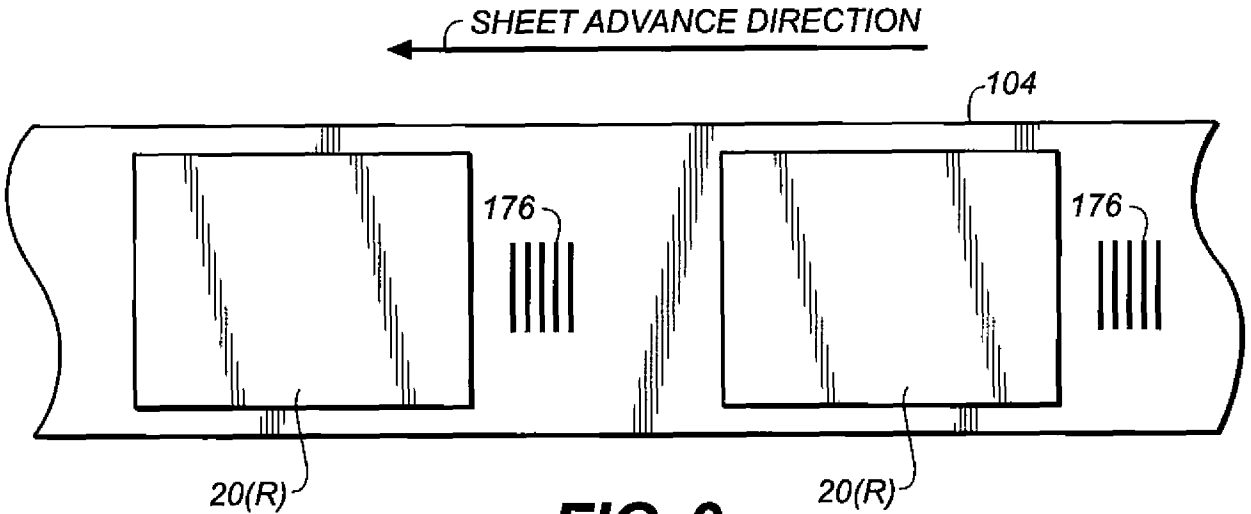
FIG. 9 is a schematic top view of receiver members coupled to a transport belt that may be used with the apparatus shown in FIG. 1.

In this embodiment, as shown in FIG. 9, for example, respectively five or six register marks 176 can be applied such that each register mark 176 may be oriented substantially perpendicular to the transport direction for each printing module M1-M5, including the thin film application module $M_F$. In one embodiment, a guide mark may be initially applied, to facilitate determining the position of the other register marks. This register guide mark could preferably be applied in black or produced by a printing unit using the "Key" color. In one embodiment, an "application" of register marks 176 may be referred to as "printing". In another embodiment, in an electrophotographic (EP) printing machine, the register marks 176 may be applied to the endless transport web 104, photoconductor and/or an intermediate member only as toner, wherein the toner may not be fused to facilitate removal of register marks 176 at a later time. In yet another embodiment, electrophotographic (EP) printing or registration marks may include fusing. In the exemplary embodiment, the terms "printing", "applying" and "creating" in conjunction with register marks are to be understood as being synonymous and referring to the generation of a recognizable and measurable register mark.

These register marks 176 may then be detected by a registration sensor 180 (register mark sensor), as described below in FIG. 10, and can thus be analyzed as described in the incorporated references mentioned above. The analysis of register marks 176 can facilitate controlling the subsequent printing of sheets in the same printing process. The control on the basis of a register mark that has been detected by registration sensor 180, however, can be used at the earliest for a receiver member which arrives as the next receiver member at the lead edge sensor 136, such as one before the thin film applicator. In such an example, the receiver member still has all the other printing units ahead of it. However, because transport web 104 is utilized, additional sheets may be position between any two sensors.

The analysis of the register marks can be used for time-corrected printing so that imaging performed by each module is appropriately timed with the arrival of new information from registration sensor 180. The position of the next receiver member arriving at lead edge sensor 118 and the continued transport speed and time of arrival in each nip of the receiver member may be computed therefrom. As a result, register errors may be detected by calibration runs prior to an actual print job. As such, the errors can be corrected by an appropriate preliminary calibration of the printing apparatus 100.

Figure 10:
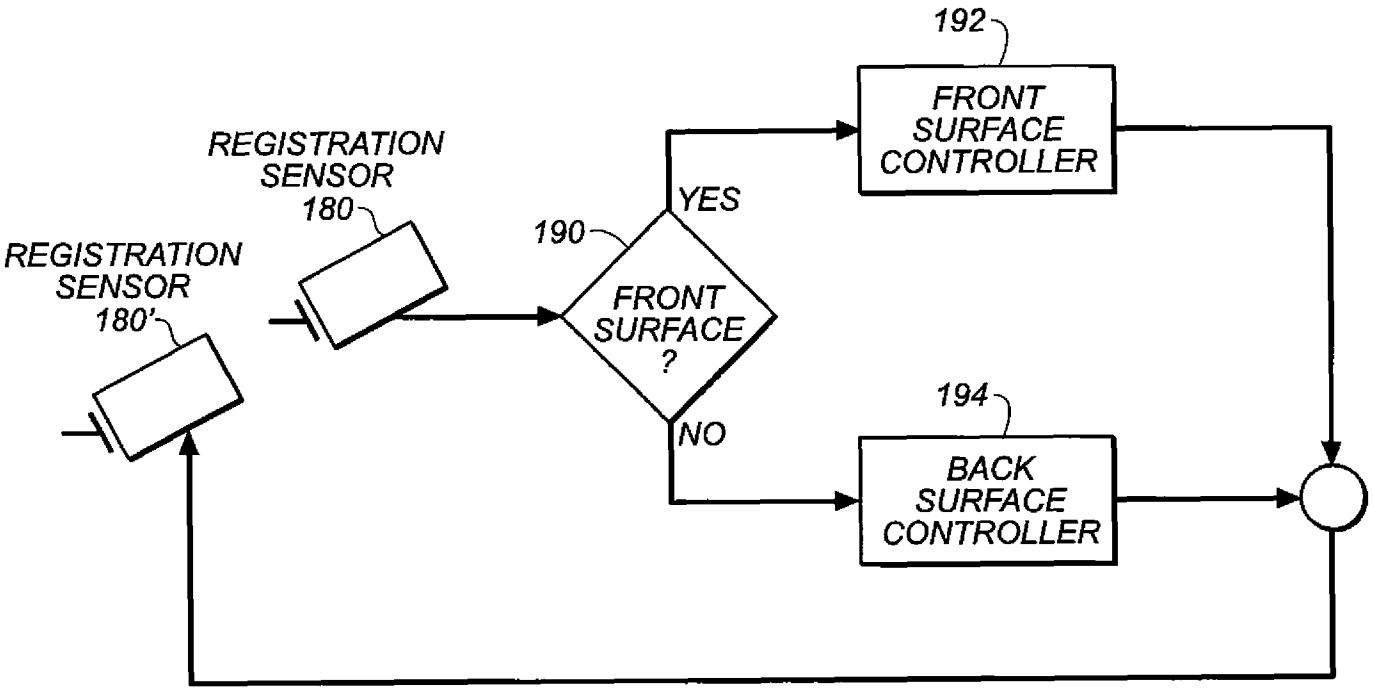
FIG. 10 is a flow diagram of method that may be used with the apparatus shown in FIG. 1.

FIG. 10 shows a type of flow diagram of a monitoring and control arrangement, as described above. The monitoring and control arrangement may include two registration sensors 180 or one registration sensor 180 which performs two functions and has been quasi-virtually doubled. This registration sensor 180 may detect arrays of register marks 176 (see FIG. 9). The registration data may be forwarded by registration sensor 180 to a query means 190, which may query whether the data comes from register marks assigned to a front surface or recto printing side of a receiver member (yes) or not (no), rather than being assigned to a reverse or verso printing side. If the response is yes, the data may be analyzed by a front surface controller 192; if the response is no, the data may be analyzed by a back surface controller 194. Based on this, control data may be released, back to registration sensor 180' and, in particular, also to printing modules M1-M5, including the thin film application module $M_F$. Also, dual controllers 192, 194 may be available, namely physically or virtually.

Figure 11:
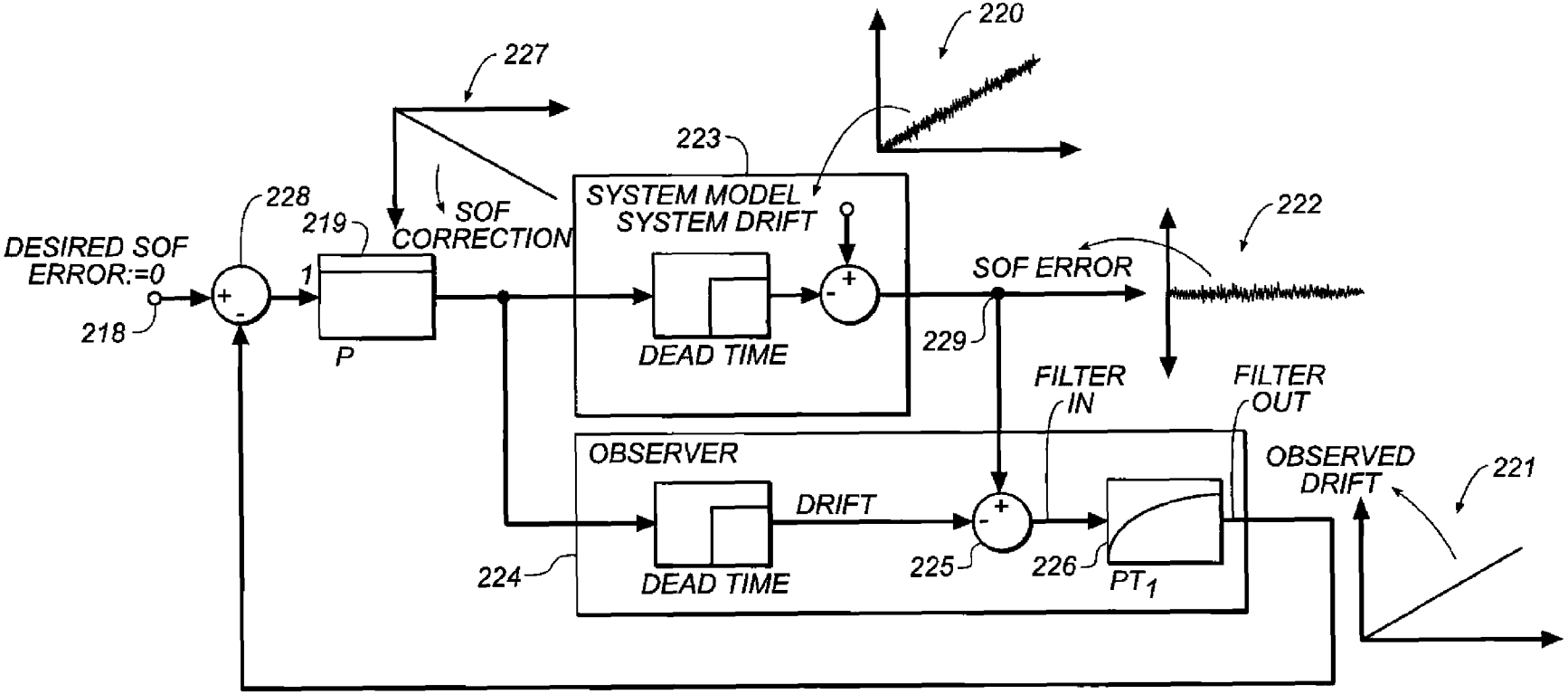
FIG. 11 is a flow diagram of another embodiment of a method that may be used with the apparatus shown in FIG. 1.

FIG. 11 shows a block circuit diagram of a monitoring and control arrangement, including a delay drift control that can be used in conjunction with the present invention. The characteristics of the delay drift control are used during the printing operation. During such an operation, a register mark may be printed on the transport web between two adjacent receiver members, wherein the register mark may include a line, or bar. At least one register mark per active printing module or printing unit may be printed. The registration sensor downstream of the last printing unit may measure these marks to determine the register of the receiver member, such as the circumferential register, that may directly precede the register marks of an array. As a result, deviations from the optimal register (i.e. circumferential register) may be determined, and the register error of the subsequently following sheets may be corrected accordingly relative to zero. This may be applicable at the earliest to the receiver member, which is detected as the next receiver member, for example, by a lead edge sensor, as described in greater detail in U.S. Ser. No. 11/847,868 which is incorporated by reference.

As shown in FIG. 11, an imaged frame may be pre-specified for the imaging region on the imaging cylinder. The start time of this frame (Start of Frame—SOF) may be controlled. Therefore, an error of circumferential registration can also be viewed as an SOF error, and this error may be substantially equal to zero (NOMINAL value). A request (Desired SOF error:=0) may be used at point 218 on entry into the monitoring and control arrangement in FIG. 9. In the illustrated control loop, a proportionality link 219 is labeled "P" and may multiply an observed value 221 as control deviation after it has been inverted at inverter 228 with a proportionality factor "1" (i.e., remains unchanged), so that the observed value 21 becomes setting value 227, as indicated. How this observed value 221 or setting value 227 is determined or yielded is described in more detail below.

In a model of the viewed or observed system (system model) 223, using a controlled system as basis, it may be assumed that within the already described "dead time" the circumferential register assigned to this receiver member may be subject to a drift and to statistical noise. In such an example, the drift may be quasi counter-controlled by reverse "presentation" for correction. In the exemplary embodiment, "dead time" may refer to the time during which a receiver member moves from lead edge sensor 180 to registration sensor 180' and is processed by the LCU. For example, a substantially linear systematic drift (system drift) is assumed, wherein the drift may be superimposed by the noise and over time may lead to position changes of the register marks, as illustrated in region 220. This is the ACTUAL value which may be generated in the system and which may be present at point 229. If the drift is corrected, as shown in region 222, the statistical noise around the requested NOMINAL zero value (SOF value) may remain, whereby the noise cannot be further removed by correction.

In order to achieve the desired control, the system may be reproduced on the side of an "observer" via the control loop. On the observer 224 side of the observed system, the drift of the system may be observed and taken into account in point 225 via the ACTUAL value obtained in point 229. In order to synchronize the observer with the system, the dead time may be taken into consideration.

The ACTUAL value obtained at point 225 from the system, as shown in region 220, is input—in order to smooth said value and eliminate the noise—as filter input data (FilterIn) in a filter 226 labeled "PT1". The filter may be configured to act as a low-pass filter. This may be achieved by means of the following FilterIn algorithm shown below:

$$\begin{aligned} FilterIn(i) &= DriftCorrection(i-d) - RegError(i) \\ &= DriftCorrection(i-d) - \{RegData(i) - DesiredValue\} \end{aligned} \quad (1)$$

with the current control step $i$ and dead time $d$.

The parameters of said algorithm are largely self-explanatory. For example, "FilterIn" may represent the input value for filter 226, "DriftCorrection" may represent the drift to be corrected in view of the dead time, "RegError" may represent the registration error to be corrected, "RegData" may represent the registered register mark data (ACTUAL values) and "DesiredValue" may represent the desired register mark data (SET values). As a result, the determination of the difference (i−d) may takes into consideration that correction starts in the region of lead edge sensor 180, i.e., registered by dead time d earlier than the registration of register mark data in the region of registration sensor 180' (at "time" i). This determination of the difference can also be understood as the determination of the average over this period of time.

The FilterOut then results due to filter 26 in terms of:

$$FilterOut(i)=a0\cdot FilterIn(i)+(1-a0)\cdot FilterOut(i-1) \quad (2)$$

with the current control step i and the previous control step (i−1). a0 is a filter coefficient expressed in terms of:

$$a_0 = 1 - \exp\left(-\frac{\Delta t}{\tau}\right) \quad (3)$$

where Δt is the time between the current and the previous control steps t(i)-t(i−1), and τ is a time constant of filter 226. Considering an artificial pre-specified value, in particular an increase of Δt, the value of the filter coefficient or the weighting factor a0 can be varied and, thus, portions of the two addends in equation (2) can be pre-specified. This determines the degree of the "hardness" or "softness" that is being considered in view of current or previous data during control. In particular at the start of a printing process, initially a harder control should be preferable.

Finally, in equation (2), the FilterOut value, which may be represented as the observed value (Observed Drift) and is shown in region 221, and the smoothed drift which has been freed of noise, as described above, are taken into consideration for the next control at point 228 in terms of:

$$DriftCorrection(i)=FilterOut(i) \quad (4)$$

The invention has been described in detail with particular reference to certain preferred embodiments thereof, but it will be understood that variations and modifications can be effected within the spirit and scope of the invention.

PARTS LIST

| | |
|---|---|
| Receiver member | 20(R) |
| Thin film layer | 30 |
| Thin film support | 30B |
| Pattern of toner | 40 |
| Digitally patterned thin film print | 50 |
| Printer assembly | 100 |
| Thin film registration sensor | 101 |
| Finishing assembly | 102 |
| Endless transport web | 104 |
| Thin film applicator | 106 |
| Fuser roller | 108 |
| Pressure roller | 110 |
| Fusing nip | 112 |
| Logic and control unit | 114 |
| Sensors | 116 |
| Thin film application device | 117 |
| Registration reference | 118 |
| Cure lamp | 119 |
| Roller | 120 |
| Roller | 122 |
| Cleaning station | 124 |
| Photoconductive imaging roller | 126 |
| Intermediate transfer member roller | 128 |
| Transfer backup roller | 130 |
| First transfer nip | 134 |
| Surface | 136 |
| Surface | 138 |
| Second transfer nip | 140 |

-continued

| PARTS LIST | |
|---|---|
| Metal conductive film layer | 142 |
| Primary charging system | 144 |
| Exposure subsystem | 146 |
| Development station subsystem | 148 |
| Power supply unit | 150 |
| Tack-down chargers | 152 |
| Heated roller | 156 |
| Film supply roller | 158 |
| Film capture roller | 160 |
| Pressure roller | 162 |
| Nip | 164 |
| Back-up roller | 166 |
| Toner roller | 168 |
| Cleaner | 170 |
| Charger | 172 |
| Sensor | 174 |
| Registration marks | 176 |
| Registration sensor | 180 |
| Registration sensor | 180 |
| Query means | 190 |
| Front surface controller | 192 |
| Back surface controller | 194 |
| Point | 218 |
| Link | 219 |
| Region | 220 |
| Observed value | 221 |
| Region | 222 |
| Observed system | 223 |
| Observer | 224 |
| Point | 225 |
| Filter | 226 |
| Setting value | 227 |
| Inverter | 228 |

What is claimed is:

1. A printing method for producing a textured thin film image upon a receiver comprising the steps of:

a. depositing one or more toner images to form a predetermined toner image on a receiver with raised portions having more than one level of height from the receiver; and b. applying and fixing a foil directly against each of the more than one level of height of the raised portions while the toner image is at a fusing temperature where the toner adheres to the foil to create a textured thin film image having different portions that are at different heights from the receiver.

2. The method of claim 1 wherein after said fixing step a height of a thickest region less the foil thickness is at least two times a height of a thinnest region less the foil thickness.

3. The method of claim 1 further comprising fixing the adhesive image prior to applying foil.

4. The method of claim 1 wherein a volume average toner diameter of at least one said toner image is greater than 14 micrometers.

5. The method of claim 4 wherein the volume average toner diameter of at least one said toner image is greater than 20 micrometers and less than 30 micrometers.

6. The method of claim 1 wherein at least two toner images are deposited on the receiver and the toner of one toner image is at least two times greater in volume average diameter than a second toner image.

7. The method of claim 6 wherein at least one toner image is produced with toner less than 9 micrometers in volume average diameter and another toner image is produced with toner greater than 14 micrometers in diameter.

8. The method of claim 1 wherein one of the one or more toner images contains no pigment.

9. The method of claim 1 wherein variable information is used to print the textured thin film image such that each page produced contains unique information.

10. The method of claim 1 further comprising depositing an additional one or more toner images after said fixing step.

11. The method of claim 10 wherein said step of depositing an additional one or more toner images is on top of the foil.

12. The method of claim 1 wherein a screen frequency of the one or more toner images is less than 160 lines per inch.

13. The method of claim 1 wherein the foil adheres to both high and low areas of the one or more toner images.

14. The method of claim 1 wherein the foil adheres predominantly to only the high areas of the one or more toner images.

15. The method of claim 1 wherein after said fixing step a height of a thickest region less the foil thickness is at least five times a height of a thinnest region less the foil thickness.

16. An apparatus for producing a textured thin film image upon a receiver, the apparatus comprising:

a first imaging device that deposits at least one toner image on a receiver to form a predetermined first toner image that has portions with a first height and a second toner image on the first toner image having portions with a second height above the first toner image;

a fuser that fuses the first toner image and the second toner image to the receiver; and an application device that heats the first toner image and the second toner image to make the first toner image and the second toner image adhesive and that presses a thin film layer directly to the first toner image and the second toner image while the first toner image and the second toner image are adhesive to adhere the first toner image and the second toner image to the thin film and that that pulls the thin film from the first toner image and the second toner image so that portions of the thin film that adhere to the first toner image and the second toner image separate from the thin film to form a thin film image having first portions adhering to the first toner image at a first heights from the receiver and second portions adhering to the second toner image at second heights from the receiver that are greater than the first heights.

17. The apparatus in accordance with claim 16 further comprising a second imaging device that facilitates depositing at least one toner image on the receiver to form the second toner image, wherein the first height of the first toner image is substantially greater than the second height of the second toner image.

18. The apparatus in accordance with claim 17 further comprising a finishing assembly that comprises a fuser roller and an opposing pressure roller, the finishing assembly is positioned between the application device and at least one of the first and second imaging devices to facilitate fixing the first toner image and the second toner image to the receiver prior to the application of the thin film layer.

19. The apparatus in accordance with claim 18 further comprising a third imaging device that is positioned adjacent the finishing assembly to facilitate depositing at least one third toner image on the thin film layer.

20. The apparatus in accordance with claim 16, wherein the thin film layer comprises a metal foil.

21. The apparatus in accordance with claim 16, wherein the first height of the first toner image is two times greater than the second height of the second toner image.

22. The apparatus in accordance with claim 16, wherein the first height of the first toner image is five times greater than the second height of the second toner image.

23. The apparatus in accordance with claim 16, wherein the first toner image comprises a first toner that has a volume average toner diameter that is substantially greater than the volume average toner diameter of a second toner of the second toner image.

24. An apparatus for producing a textured thin film image upon a receiver, the apparatus comprising:

a first imaging device that deposits at least one toner image on a receiver to form a predetermined adhesive first toner image that has a first height;

a second imaging device that deposits at least one toner image on the first toner image to form a predetermined second toner image that has a second height above the first toner image, the first height of the first toner image is substantially greater than the second height of the second toner image; and an application device that couples a thin film layer directly to the first toner image and the second toner image when the first toner image and the second toner image are at a fusing temperature that makes the toner adhesive to the thin film layer to adhere the first toner image and the second toner image to the thin film and that that pulls the thin film from the first toner image and the second toner image so that portions of the thin film that adhere to the first toner image and the second toner image separate from the thin film to form a thin film image having first portions adhering to the first toner image at first heights from the receiver and second portions adhering to the second toner image at second heights from the receiver that are greater than the first heights; wherein the first toner image comprises a first toner that has a volume average toner diameter that is substantially greater than the volume average toner diameter of a second toner of the second toner image.

* * * * *